US006748833B2

(12) United States Patent
Williams

(10) Patent No.: US 6,748,833 B2
(45) Date of Patent: Jun. 15, 2004

(54) IMPACT WRENCH

(76) Inventor: Matthew Lance Williams, 12 Valleyview Rise, Hampton Park, Victoria (AU), 3976

( * ) Notice: Subject to any disclaimer, the term of this patent is extended or adjusted under 35 U.S.C. 154(b) by 0 days.

(21) Appl. No.: 10/138,259

(22) Filed: May 6, 2002

(65) Prior Publication Data

US 2002/0162428 A1 Nov. 7, 2002

(30) Foreign Application Priority Data

May 7, 2001 (AU) ..... PR4790

(51) Int. Cl.[7] ..... B25B 19/00
(52) U.S. Cl. ..... 81/465; 81/466
(58) Field of Search ..... 81/465, 463, 466; 73/93

(56) References Cited

U.S. PATENT DOCUMENTS 3,996,821 A * 12/1976 Murray ..... 81/177.2
4,079,643 A * 3/1978 Evans ..... 81/439
4,367,664 A * 1/1983 Ekshtut ..... 81/436
5,033,337 A * 7/1991 Thomas, III ..... 81/177.2
5,953,966 A * 9/1999 Spirer ..... 81/57.3
6,085,621 A * 7/2000 Nezigane ..... 81/465
6,354,178 B2 3/2002 Pool et al.
2003/0041705 A1 * 3/2003 Coulter ..... 81/487

FOREIGN PATENT DOCUMENTS

GB 2193135 A * 3/1988 ..... 81/465

* cited by examiner

*Primary Examiner*—Lee D. Wilson
(74) *Attorney, Agent, or Firm*—Hoffman, Wasson & Gitler, P.C.

(57) ABSTRACT

An impact wrench (1) having a handle (3), an arm (7) pivotally connected to the handle (3) and of unitary construction with the handle (3), and a key (11) on the arm (7) for coupling with a keyseat of a wrench tool, such as a socket of a socket wrench. An impact surface (2) is located at an upper end of the handle (3) and has an impact-resistant cap (5). In use, a socket is fitted to the key (11) and placed into engagement with a nut or bolt which needs to be loosened. Striking the cap (5) with a hammer in the direction of arrow 17 causes rotation of the arm (7) and the socket and for the nut or bolt to loosen.

13 Claims, 2 Drawing Sheets

IMPACT WRENCH

FIELD OF THE INVENTION:

This invention relates to an impact wrench. In particular, the invention concerns an impact wrench for use with a variety of nuts and bolts.

BACKGROUND OF THE INVENTION

There are many types of wrenches for gripping and turning nuts and bolts. However, where the nut or bolt being turned is attached to another member which may itself turn when the nut or bolt is being turned by the wrench, it is generally necessary to hold the other member fast in order to turn the nut or bolt, otherwise the other member and nut or bolt will turn in unison.

Where it is readily possible to hold the other member fast by means such as another wrench, such situations do not present a problem. However, there are occasions when this is not easily achievable, for example, in a car engine, the front pulley is generally bolted onto a rotatable shaft which is not readily accessible for holding fast against rotation. Furthermore, in some cars, there may not be a great deal of clearance between the nut or bolt attaching the pulley, the radiator, the engine bay or other engine components, thereby leaving little room to remove the nut or bolt.

Thus there is a need in some situations for a wrench design which can be used in confined spaces. Furthermore, there is a need for a wrench design which can be used to loosen members such as nuts or bolts even though they are attached to other members which may be rotatable with the nut or bolt.

SUMMARY OF THE INVENTION

It is an object of the invention to provide an impact wrench that meets at least one of the needs referred to above.

According to the present invention there is provided an impact wrench having:

a handle having an impact surface;

an arm pivotally connected to the handle and of unitary construction with the handle; and a key or a keyseat on the arm for coupling with a respective key or keyseat of a wrench tool, wherein the wrench tool may rotate a nut or bolt when the impact surface is impacted upon.

The unitary construction enables the impact wrench to be used in confined spaces without the problem of the arm detaching from the handle by accident.

Preferably, the key or keyseat enables the coupling of different wrench tools to the arm. The coupling may be magnetised.

In one form of the invention, the arm may have a keyseat for receiving a key of a wrench tool. For instance, the keyseat may have an aperture into which is insertable a like-shaped key of a wrench tool.

In another form of the invention, the arm may have a key extending laterally from one or both sides of the arm and the key may be receivable within a like-shaped keyseat of a wrench tool. The key may, for instance, have a rectangular body extending from both sides of the arm.

Preferably, the arm and the handle pivot beside one another in spaced parallel planes, and the arm may be pivoted relative to the handle through an arc of at least 60 degrees. More preferably, the arm is pivotable relative to the handle through an arc of at least 240 degrees. If the arm does not have a key or keyseat extending therefrom in an obstructive manner, then the arm may be pivotable through one or more complete revolutions relative to the handle. This enables the impact wrench to not only loosen a nut or bolt, but to also unscrew the nut or bolt completely.

The arm may be pivotally connected to the handle with a rivet, a pin, a nut and bolt combination, or using any suitable means known to persons skilled in the art.

The handle and arm may comprise any suitable material or materials which can withstand an impact from a member such as a hammer. Steel is a material which is suitable, particularly steel in alloy form, eg. chrome or molybdenum alloy.

Preferably, the impact surface is located at an end of the handle and remote from the pivotal connection with the arm. Preferably, the impact surface includes an impact-resistant cap. The cap may comprise any suitable material, such as metal or plastics material, The cap may be a separate component or it may be an integral part of the handle. If desired, the cap may have a grip that encompasses an upper end of the handle. The cap may have a circumferential flange for shielding the user's hand from a misdirected hammer blow.

In a preferred form of the invention, the impact wrench includes a wrench tool coupled to the key or keyseat on the arm. The wrench tool may comprise any suitable tool for engaging a nut or bolt. The wrench tool may comprise, for instance, an open end of a spanner, a ring spanner, or a socket of a socket wrench. Preferably, the wrench tool comprises a socket of a socket wrench.

In another aspect of the invention, there is provided a method of loosening a first member from a second member held to the first member in a manner which allows the two to rotate together, said method comprising loosening the first member by rotation with respect to the second member by using an impact wrench as hereinbefore described and applying a blow to the impact surface of the impact wrench.

BRIEF DESCRIPTION OF THE DRAWINGS

Particular preferred embodiments of the invention will now be described by way of example with reference to the drawings in which.

DESCRIPTION OF THE PREFERRED EMBODIMENTS

Figures 1, 2:
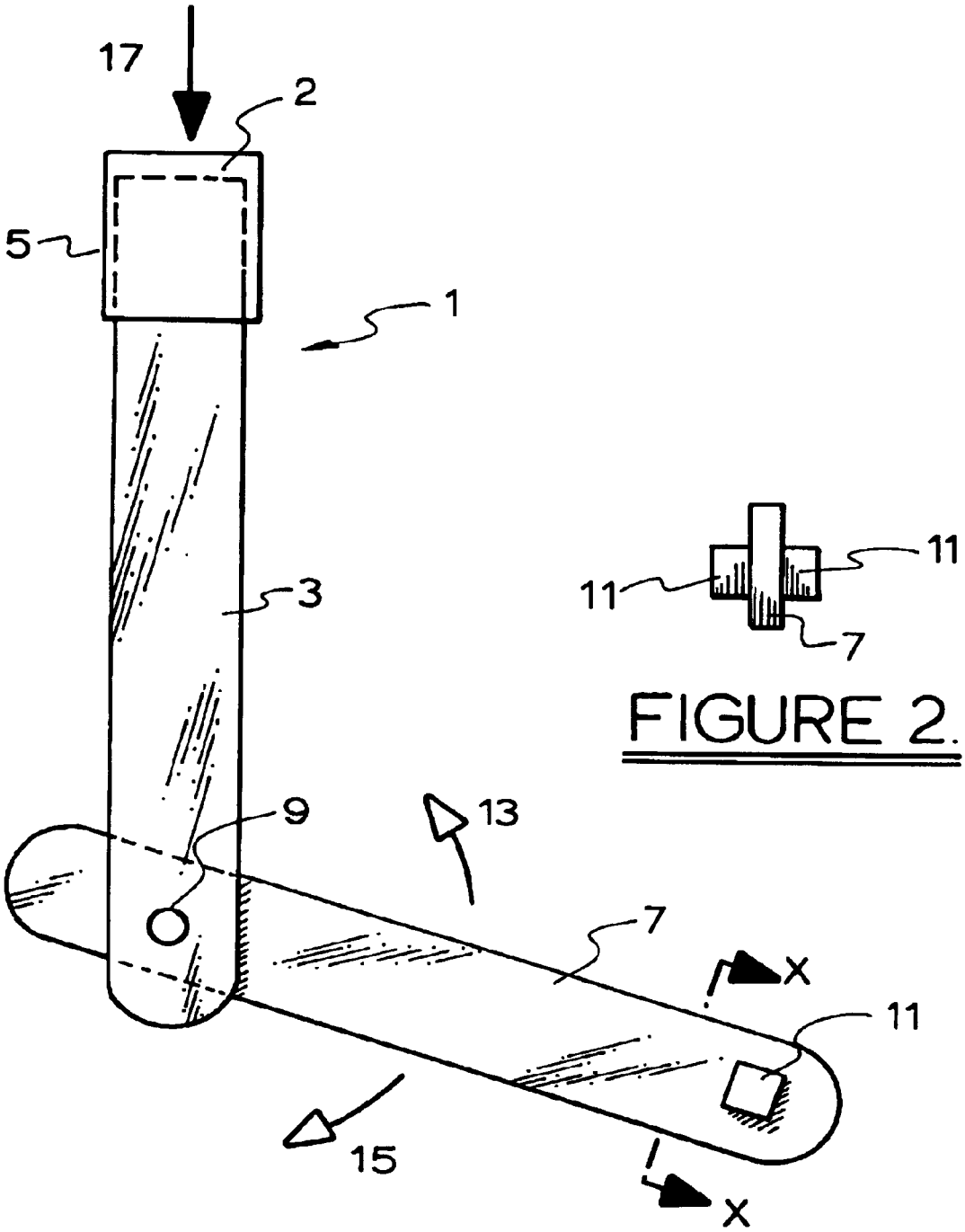
FIG. 1 is an elevation view of an impact wrench according to an embodiment of the invention.
FIG. 2 is a view along the section X—X of an arm of the impact wrench of FIG. 1.

In all of the drawings like reference numerals refer to like parts.

The figures show two embodiments of an impact wrench 1 having a handle 3, an arm 7 pivotally connected to the handle 3 and of unitary construction with the handle 3, and a key 11 (FIGS. 1 and 2) or keyseat 20 (FIG. 3) on the arm 7 for coupling with a respective keyseat or key of a wrench tool (not shown).

The handle 3 and arm 7 are made of an impact-resistant material such as steel or a steel alloy.

Figure 3:
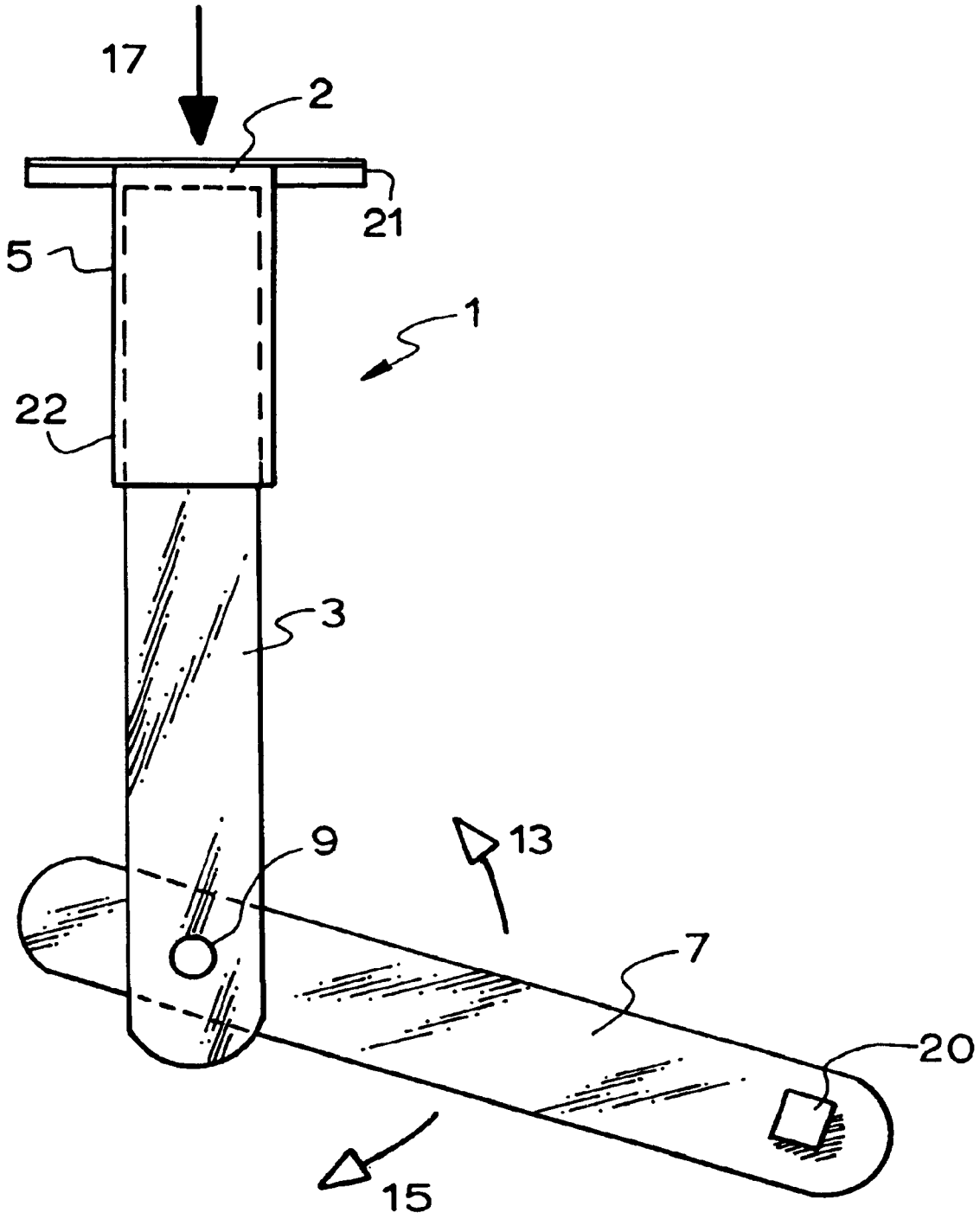
FIG. 3 is an elevation view of an impact wrench according to another embodiment of the invention.

An impact surface 2 is located at an upper end of the handle 3. The impact surface 2 has a cap 5 made of a high impact-resistant plastics material. FIG. 3 shows that the cap 5 may extend further along the handle 3 and serve as a grip 22 for a user of the wrench 1. FIG. 3 also shows that the cap 5 may have a circumferential flange 21 for shielding the user's hand from a misdirected hammer blow.

As seen in FIGS. 1 and 2, the key 11 has a rectangular body 11 extending laterally from both sides of the arm 7. The key 11 is receivable within an aperture of a wrench tool. As seen in FIG. 3, the keyseat 20 includes a rectangular aperture for receiving a key of a wrench tool. The wrench tool preferably comprises a socket of a socket wrench and a range of socket sizes may be used with the impact wrench 1.

The handle 3 and the arm 7 are situated next to one another and are pivotally connected with a pin 9. The pin 9 enables the arm 7 to pivot relative to the handle 3, in a spaced parallel plane to the handle 3, in either of the directions represented by arrows 13 and 15. The arm 7 can pivot in an arc of at least 60 degrees. The arm 7 may be pivoted through one or more complete revolutions if the key 11 does not extend from the side of the arm 7 to which the handle 3 is connected.

It is possible to operate the impact wrench 1 with the handle 3 directed in any direction provided that the arm 7 is arranged to point generally laterally with respect to the handle 3.

In use, a socket of a socket wrench is fitted to the key 11 or keyseat 20 and the socket is placed into engagement with a nut or bolt which needs to be loosened. The arm 7 is positioned such that it extends generally laterally whereas the handle 3 is positioned such that it extends generally vertically. Striking the cap 5 with a hammer in the direction of arrow 17 causes rotation of the arm 7 and the socket. The impact has the effect of loosening the bolt or nut by virtue of the inertia of a member to which the nut or bolt is connected acting to prevent corresponding instantaneous rotation of that member. Space permitting, the arm may be rotated through multiple revolutions in order to unscrew the loosened nut or bolt (eg. a crankshaft bolt of an engine) completely.

What is claimed is:

1. An impact wrench having:

a handle having an impact surface;

an arm pivotally connected to the handle and of unitary construction with the handle; and a connecting mechanism for keying the arm to a wrench tool, wherein a nut or bolt is rotatable by the wrench tool when the impact surface is impacted upon, the wrench tool rotating a nut or bolt either in a first direction to tighten the nut or bolt, or in a second direction to loosen the nut or bolt.

2. The impact wrench of claim 1, wherein the connecting mechanism has a keyseat having an aperture into which is insertable a key of the wrench tool.

3. The impact wrench of claim 1, wherein the connecting mechanism has a key extending laterally from one or both sides of the arm and the key is receivable within a keyseat of the wrench tool.

4. The impact wrench of claim 1, wherein the arm and the handle pivot beside one another in spaced parallel planes.

5. The impact wrench of claim 1, wherein the arm is pivotable relative to the handle through an arc of at least 60 degrees.

6. The impact wrench of claim 1, wherein the arm is pivotable relative to the handle through an arc of at least 240 degrees.

7. The impact wrench of claim 1, wherein the arm is pivotable through a complete revolution relative to the handle.

8. The impact wrench of claim 1, wherein the impact surface is located at an end of the handle remote from the pivotal connection with the arm.

9. The impact wrench of claim 1, wherein the impact surface includes an impact-resistant cap.

10. The impact wrench of claim 9, wherein the cap has a grip that encompasses an upper end of the handle.

11. The impact wrench of claim 9, wherein the cap has a circumferential flange.

12. The impact wrench of claim 1 further including a wrench tool connected to the arm.

13. The impact wrench of claim 12, wherein said wrench tool is selected from the group consisting of an open end of a spanner, a ring spanner, and a socket of a socket wrench.

* * * * *